US005711557A

United States Patent [19]

Nicolosi

[11] Patent Number: 5,711,557

[45] Date of Patent: Jan. 27, 1998

[54] DOOR STOP

[76] Inventor: Louis Nicolosi, 1 Westchester Ave., Jericho, N.Y. 11753

[21] Appl. No.: 764,250

[22] Filed: Dec. 12, 1996

[51] Int. Cl.[6] ..... E05C 19/18

[52] U.S. Cl. ..... 292/288; 292/343

[58] Field of Search ..... 292/288, 343, 292/289, DIG. 17, 342

[56] References Cited

U.S. PATENT DOCUMENTS

| | | | |
|---|---|---|---|
| 83,967 | 3/1868 | Howell . | |
| 155,895 | 10/1874 | Smith | 292/289 |
| 314,105 | 3/1885 | Carnes . | |
| 485,613 | 11/1892 | Deane . | |
| 1,616,265 | 2/1927 | Kroehling | 292/288 |
| 4,648,152 | 3/1987 | Grewall . | |
| 4,738,002 | 4/1988 | Shank | 16/82 |
| 4,831,688 | 5/1989 | Deininger . | |
| 5,027,471 | 7/1991 | Barnes . | |
| 5,044,681 | 9/1991 | Neighbors . | |
| 5,511,837 | 4/1996 | Dempsey et al. | 292/288 |

*Primary Examiner*—Rodney M. Lindsey

*Attorney, Agent, or Firm*—Schweitzer Cornman Gross & Bondell LLP

[57] ABSTRACT

A door stop for mounting on a door hinge has an inverted U-shaped support and a base aligned substantially perpendicularly to the support. The can have at least three sides with an opening in the center for easy and confident handling. The door stop can be comprised of a single length of metal rod formed into the support and base portions. The base can be triangular in shape having three integrally connected sides. The sides can form a closed triangular base or can form a narrow resiliently expandable gap through which a carrying means can be urged into the opening of the base. A free end of the support portion extends below the base to improve balance when the door stop is mounted on a hinge and to incline the base when the door stop is placed on a floor surface for engagement with a lower portion of a door.

4 Claims, 3 Drawing Sheets

DOOR STOP

FIELD OF THE INVENTION

The present invention relates generally to devices for propping-open doors, and more particularly to such devices which connect to and are supported from conventional door hinges.

BACKGROUND AND SUMMARY OF THE INVENTION

In certain situations, such as when attempting to extinguish a fire in a building or a dwelling, it is often desirable to maintain doors in open positions to provide routes of egress and to control air flow. A commonly known way to accomplish this is to simply insert a wedge between the bottom of the door and the floor. This method, while relatively simple and inexpensive, does have some disadvantages. Specifically, to insert the wedge, the person must typically bend to the surface of the floor and adjust the wedge to hold the door in place. Also, these types of wedges are easily displaced and rendered ineffective.

Another type of known door stop, such as that disclosed in U.S. Pat. No. 4,831,688 to Deininger, is mounted on a hinge between the door and door jam. As can be seen in FIG. 1, this prior art door stop 1 includes a quadrilateral base portion 2 connected to a J-shaped support portion 3. The J-shaped portion 3 hooks over a pivot portion 4 of a door hinge 5 which includes the ring portions 6 of the hinge 5 and the hinge pin 7 directed therethrough. The base 2 extends horizontally outwardly from the J-shaped support portion 3 and prevents the hinge plates 8, and thus the door, from closing.

This prior art door stop is somewhat of an improvement over the simple wedge described above, however, it has some significant limitations. Specifically, the J-shaped support 3 is too short and too wide to accommodate various hinge designs. Since the J-shaped support 3 is relatively wide, it must mount over the pivot portion 4 of the hinge 5, as shown in FIG. 2. If the pivot 4 is too wide, the door stop 1 will not work. Also, as shown in FIG. 3, since the free end of the J-shaped support 3 is relatively short, the door stop 1 can become dislodged, rendering it ineffective.

Another significant limitation of this prior art design is that it cannot be handled or carried easily, especially while wearing gloves, such as fire fighter's gloves. Also, as best seen in FIG. 1, the pointed edges and corners 9 of this prior art design can become embedded in the door and door jam surfaces thereby causing damage and possibly hindering removal. Moreover, this type of door stop cannot be easily stacked and cannot be easily carried on a loop or belt. Finally, the process of making this type of prior design is a two-step manufacturing process. First, the material must be stamped, then the material must be bent.

Since fire fighters necessarily carry a lot of equipment on their person, it is generally desirable to minimize the weight of that equipment. Also, it is desirable to optimize the way in which that equipment is carried. In addition, in emergency situations, such as fires, time is of the essence. Further, any equipment failure in these emergency situations can be fatal. Therefore, what is desired is a door stop which is lightweight, easy to carry and handle, which can be mounted and removed rapidly and which is adaptable to many door hinge configurations.

The door stop of the present invention is preferably formed of a single piece of rigid metal rod forming a U-shaped support and a triangular base. The base has a center opening defined by the sections of rod forming the triangle. This opening allows the door stop to be mounted on a loop or belt for carrying and is preferably large enough to accept a gloved finger therethrough so that it can be positively gripped when installing or removing. Thus the door stop of the present invention is easy to carry, handle, insert and remove.

The U-shaped support is adapted to hook over the planar portions of the hinge plates of a door hinge. Accordingly, the support is preferably narrow so that it can rest on the planar portion of a hinge plate of the door hinge between the ring portions and the door or door jam. Therefore, the door stop of the present invention can accommodate many door hinge configurations regardless of the shape and dimensions of the ring portions and hinge post. A free end of the U-shaped support portion is preferably longer than an opposite side of the U-shaped support section which connects to the base such that the side extends below the horizontal base of the door stop. The extended free end provides stability when the door stop is mounted on a door hinge and reduces the likelihood that the door stop will become dislodged when, for example, the door is slammed. Thus the present door stop mounts securely and reliably on many types of door hinges. In addition, the extended side provides an incline to the base when, as is sometimes the case, the door stop is placed on a floor surface either beneath the door (like a wedge) or between the door and door jam. Further, the method of forming the door stop from a unitary rod involves an economical process which creates a base with rounded corners which are unlikely to become embedded in or otherwise damage the door or door jam.

Thus, the design of the present invention provides a door stop which is lightweight, easy to carry on a belt ring or such, easy to handle while wearing protective clothing, economical to manufacture and which will accommodate many door hinge configurations.

BRIEF DESCRIPTION OF THE DRAWINGS

For a complete understanding of the above and other features of the invention, reference shall be made to the following detailed description of the preferred embodiments of the invention and to the accompanying drawings, wherein.

DETAILED DESCRIPTION OF THE INVENTION

Figure 1:
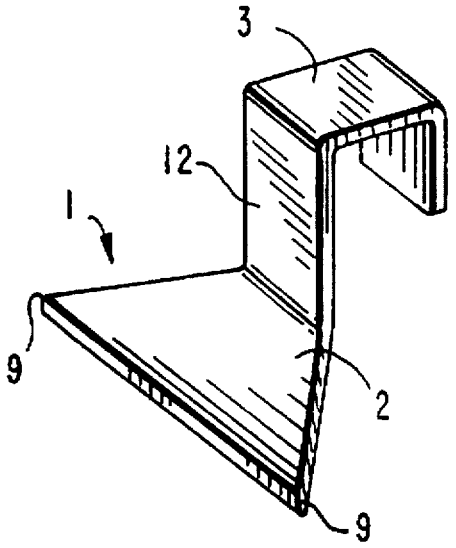
FIG. 1 PRIOR ART
FIG. 1 is a perspective view of a Prior Art door stop.
Figure 2:
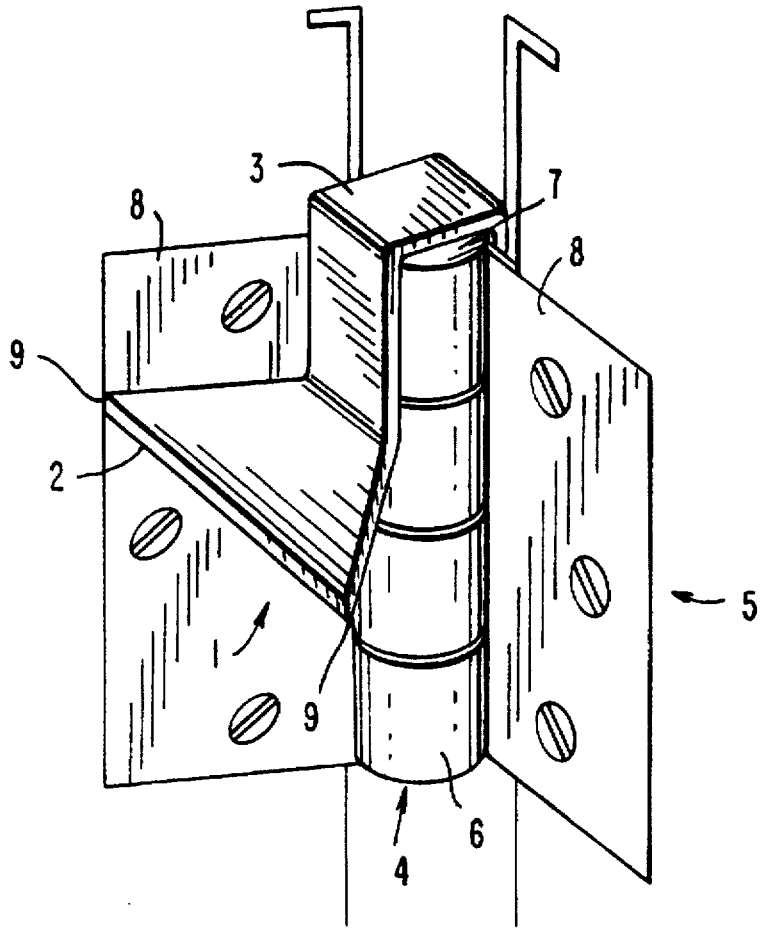
FIG. 2 PRIOR ART
FIG. 2 is a perspective view of the Prior Art door stop of FIG. 1 mounted on a door hinge.
Figure 3:
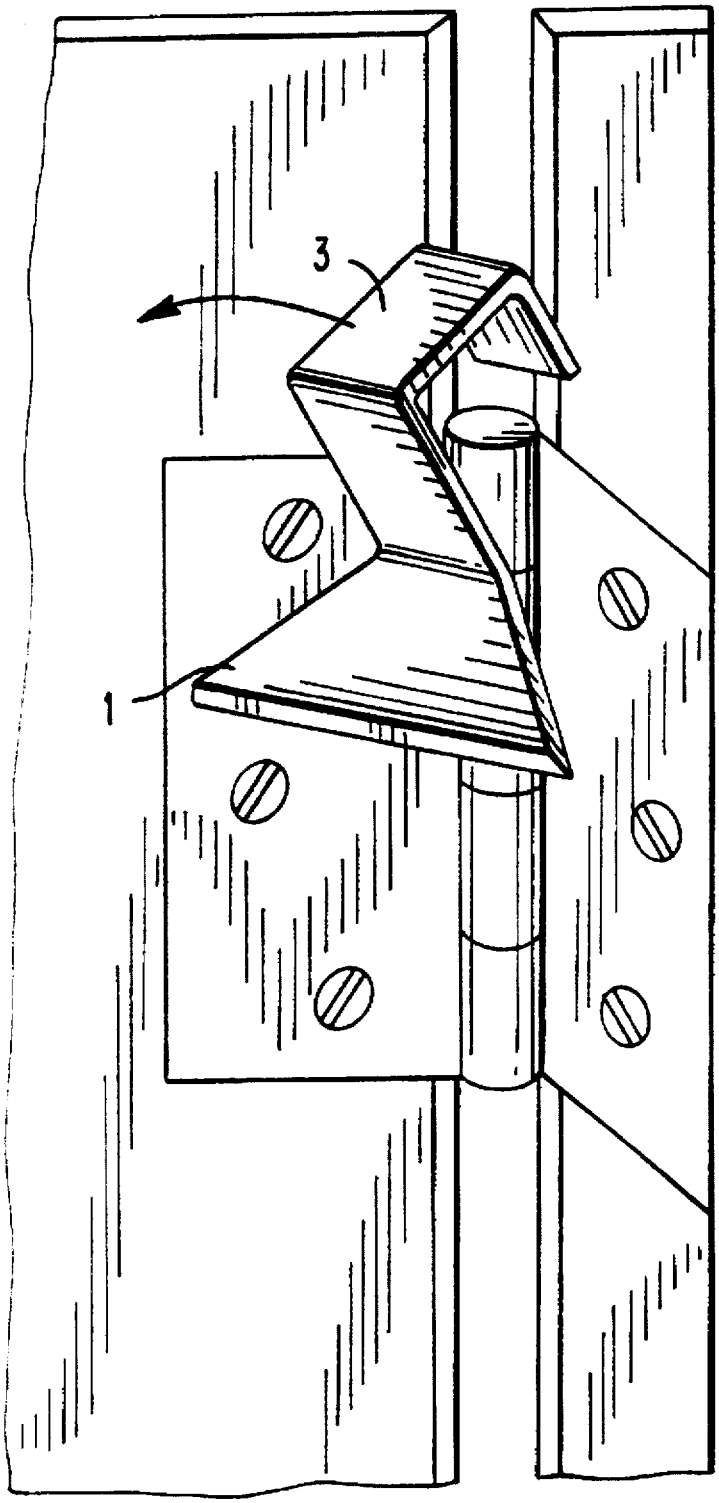
FIG. 3 PRIOR ART
FIG. 3 is a perspective view of the Prior Art door stop of FIG. 1 showing the door stop becoming dislodged by a closing door.
Figure 4:
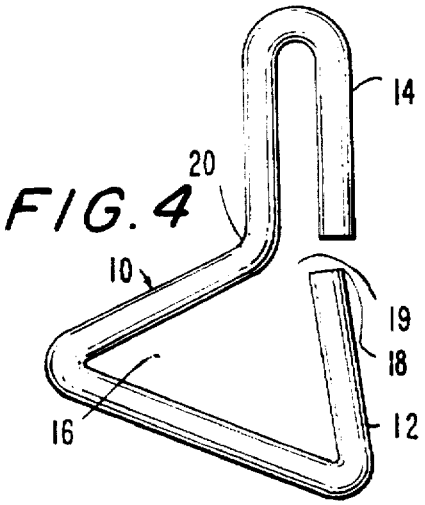
FIG. 4 is a perspective view of the door stop of the present invention.

Referring to FIG. 4, the door stop 10 of the present invention includes a base 12 and a U-shaped support 14 connected thereto. The door stop 10 is preferably formed of a unitary piece of metal rod having at least four bends forming the U-shaped support 14 aligned perpendicularly to the base 12.

The base 12 is preferably triangular and has a center opening 16 bounded by the rod forming the door stop 10.

The opening 16, in addition to decreasing weight, allows the door stop 10 to be mounted on a carrying means, such as a loop or belt. In addition, the opening is preferably large enough to accept a finger covered by a protective glove so that the door stop 10 can be easily and confidently handled while it is being installed and removed. The free end 18 of the base 12 can be spaced from an opposing section 20 of the rod at the junction between the base 12 and the U-shaped support 14 thereby forming a resiliently deformable gap 19 through which a carrying means can be urged. Alternately, the end 18 can be fixedly connected to the section 20 of the rod forming a closed loop.

Figure 5:
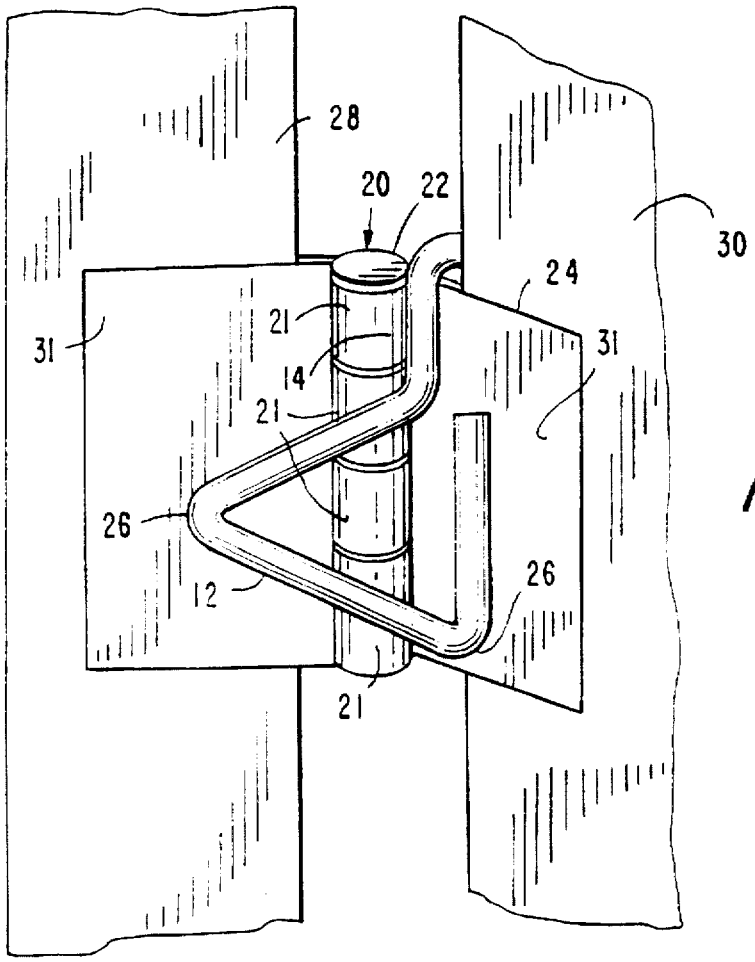
FIG. 5 is a perspective view of the door stop of FIG. 1 mounted on a door hinge.

Referring to FIG. 5, the door stop 10 can be installed on a door hinge 20 by mounting the U-shaped support portion 14 over the pivot portion of the hinge 20, that is, over the ring portions 21 and hinge post 22. However, preferably the cross section of the rod forming the door stop 10 is narrow such that the support 14 can be mounted over a planar portion 31 of a hinge plate 24 between the ring portions 21 and the door jam 30 (or door 28). Thus, the door stop 10 of the present invention can accommodate many hinge configurations regardless of the dimension of the hinge pin 22 and ring portions 21. In any case the base 12 extends horizontally perpendicularly from the U-shaped support 14 and prevents the door 28 from closing. Preferably, the base 12 has rounded corners 26 which will not puncture or otherwise damage the surfaces of the door 28 or doorjamb 30.

Figure 6:
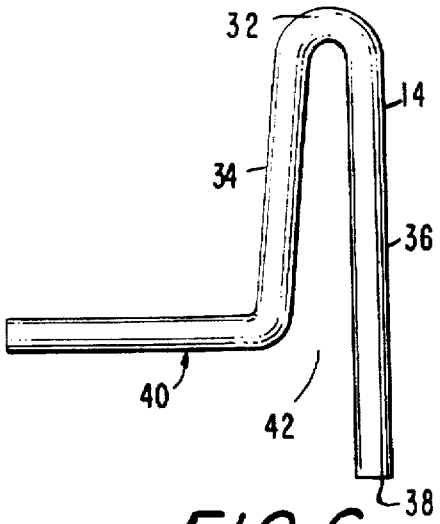
FIG. 6 is a side view of the door stop of FIG. 1.

Referring to FIG. 6, the U-shaped support 14 has a trough 32 and two side portions 34, 36. A shorter side portion 34 connects integrally with the base 12. A second side portion 36 is longer than the first side portion 34 and has a free end of 38 which extends below the bottom 40 of the horizontal base 12. In other words, a plane defined by the bottom 40 of the base 12 lies between the free end 38 of the second side portion 36 and the trough 32. When the door stop 10 is mounted on a door hinge, this added length improves stability. Also, some doors are hinged only at the bottom and top of the door jam. In these cases, the door stop can be placed on the floor between the door and door jam and the longer side 32 of the door stop 10 will maintain the base 12 at an inclined angle sufficient to engage the door 28 and prevent its closing. Alternatively, the door stop 10 can be placed underneath the door 28 and used as a simple wedge as described above.

Preferably, the support 14 has an opening 42 with a width less than a width of the ring portions 21 or the hinge pin 22 of the hinge 20 and greater than a width of the planar portions 31 of the hinge 20 such that when the door stop 10 is mounted to the hinge 20, it mounts onto the planar portion 31 in a secure fashion. Also, preferably the length of the support 14 is greater than the opening 42 thereof to enhance stability.

It should be understood, of course, that the specific form of the invention herein illustrated and described is intended to be representative only as certain changes may be made therein without departing from the clear teachings of the disclosure. Accordingly, reference should be made to the following appended claims in determining the full scope of the invention.

What is claimed is:

1. A lightweight door stop for mounting on a door hinge comprising:

(a) a single section of wire rod formed and shaped to provide:

(i) an inverted, U-shaped support having first and second downwardly-depending legs joined by a trough section, and said support being aligned in a plane; and (ii) a substantially planar base fixed to an end of said first leg of said support, a bottom of said base being aligned in a plane substantially perpendicular to said plane of said support;

(b) said base having at least three sides and a center opening adapted to receive a gloved finger or carrying means, an end of one of said sides being connected to said end of said first leg of said support;

(c) said support being adapted to mount on a hinge plate of the door hinge to maintain the door in an open position;

(d) whereby said support provides for secure mounting of the door stop on various hinges regardless of the configuration of the hinge pin thereof, and whereby means can be directed through said opening for convenient carrying, and the door stop can be gripped through said opening for rapid mounting and removal.

2. A lightweight door stop as in claim 1, wherein an end of said second leg extends below said bottom of said base such that said plane of said base is intermediate said trough and said end of said second leg;

(a) whereby said second leg serves to partially balance the door stop when mounted on the hinge plate and whereby, when the door stop is placed on a floor surface, said end of said second leg serves to support said base at an inclined angle for use as a wedge.

3. A door stop for use in combination with a door hinge, the door hinge having two planar hinge plates of predetermined thickness joined by a hinge pin of predetermined diameter, the door stop comprising:

(a) a single section of wire rod formed and shaped to provide:

(i) an inverted, U-shaped support having first and second legs joined by a trough section, and said support being aligned in a first plane; and (ii) a substantially planar base fixed to said support, a bottom of said base being aligned in a second plane substantially perpendicular to said first plane of said support;

(b) said base having at least three sides and a center opening adapted to receive a gloved finger or carrying means, an end of one of said sides being connected to an end of said first leg; and (c) said first and second legs of said support being spaced apart a distance intermediate said predetermined thickness of said hinge plates and said predetermined diameter of said hinge pin such that said support can mount exclusively over said hinge plates;

(d) whereby said support provides for secure mounting of the door stop on various hinges regardless of the configuration of the hinge pin thereof, and whereby means can be directed through said opening for convenient carrying, and the door stop can be gripped through said opening for rapid mounting and removal.

4. A door stop as in claim 3, wherein:

(a) an end of said second leg extends below said bottom of said base such that said plane of said base is intermediate said trough and said end of said second leg;

(b) whereby said second leg serves to partially balance the door stop when mounted on the hinge plate and whereby, when the door stop is place on a floor surface, said end of said second leg serves to support said base at an inclined angle for use as a wedge.

* * * * *